United States Patent [19]

Elder et al.

[11] Patent Number: 4,875,609

[45] Date of Patent: Oct. 24, 1989

[54] DISC DISPENSER

[75] Inventors: Jerome E. Elder, Blaine; Nancy L. Mosman, Saint Fridley, both of Minn.

[73] Assignee: Minnesota Mining and Manufacturing Company, Saint Paul, Minn.

[21] Appl. No.: 164,389

[22] Filed: Mar. 4, 1988

[51] Int. Cl.[4] ..... B26F 3/02

[52] U.S. Cl. ..... 225/13; 225/25; 225/46; 225/48

[58] Field of Search ..... 225/25, 26, 36–38, 225/45–49, 13; 242/55.2, 55.53; 206/408, 409, 389, 395; 83/13

[56] References Cited

U.S. PATENT DOCUMENTS

| | | | |
|---|---|---|---|
| 3,144,970 | 8/1964 | Beschmann | 225/48 |
| 3,520,409 | 7/1970 | Gibbs, Sr. | 242/55.53 |
| 3,567,087 | 3/1971 | Schramm | 225/43 |
| 3,849,949 | 11/1974 | Steinhauser et al. | 51/406 |
| 4,245,765 | 1/1981 | Gregg | 225/13 |

*Primary Examiner*—Hien H. Phan
*Attorney, Agent, or Firm*—Donald M. Sell; Walter N. Kirn; William L. Huebsch

[57] ABSTRACT

A dispenser for concatenated pressure sensitive adhesive coated abrasive discs disposed in a supply roll comprising a container having opposite side walls each having inner and outer layers with their inner layers having aligned slots extending from top edges of the side walls to inner ends positioned generally central of said side walls, and a shaft rotatably supporting the supply roll having ends supported on support edges defining the inner ends of the slots. The container also has a front wall having retaining members at opposite edges projecting between the layers of the side walls and pivotable around a bottom edge relative to the side walls between a storage position with the front wall at a right angle relative to a bottom wall of the container and the retaining members spaced from the slots, and a dispense position with the front wall disposed at an obtuse angle relative to the bottom wall and portions of the retaining members projecting across the slots and engaging the top of the shaft to hold it in place. Also the container has a cover that can be fully closed when the front wall is in its storage position, opened to allow the front wall to be moved to its dispense position and disks to be dispensed, and moved to a partially closed position when the front wall is in its dispense position to restrict dust from entering the container.

16 Claims, 2 Drawing Sheets

DISC DISPENSER

TECHNICAL FIELD

The present invention relates to dispensers for portions of strip material from a length of the strip material wound in a supply roll, and particularly to such dispensers for concatenated pressure sensitive adhesive coated abrasive discs disposed in such a supply roll.

BACKGROUND ART

Dispensers are known for concatenated pressure sensitive adhesive coated abrasive discs disposed in a supply roll, including the dispensers described in U.S. Pats. No.s 3,912,142 and 4,245,765. Those dispensers have significant openings that allow contaminates such as dust to settle on the discs, which in severe cases encountered in some work places can degrade the adhesive coated on the discs.

DISCLOSURE OF INVENTION

The present invention provides a dispenser particularly adapted for concatenated pressure sensitive adhesive coated abrasive discs disposed in a supply roll (but which could also be used for dispensing other strip material in a supply roll) which can almost completely enclose the supply roll when not in use, and, except for a support shaft in the dispenser, can be made of a single sheet of corrugated fiberboard so that it is inexpensive enough to serve both for shipping and as a dispenser, and to be disposed of when all the discs have been dispensed.

According to the present invention there is provided a dispenser particularly adapted for concatenated pressure sensitive adhesive coated abrasive discs disposed in a supply roll, which dispenser comprises a container (preferably of corrugated fiberboard) having opposite side walls projecting from a bottom wall and each having inner and outer layers, with the inner layers of the side walls having aligned slots extending from the top edges of the side walls to inner ends positioned generally central of the side walls defined by support edges for supporting end portions of a shaft extending between the side walls to rotatably support the supply roll. A front wall of the container is pivotably mounted on the bottom wall and has retaining members attached at opposite edges projecting between the layers of the side walls. The front wall is pivotable relative to the side walls between a storage position with the front wall disposed at a first angle (preferably 90 degrees) relative to the bottom wall, and a dispense position with the front wall disposed at a second greater angle (preferably an obtuse angle such as 110 degrees) relative to the bottom wall, and the retaining members having retaining portions spaced from the slots in the inner layers of the side walls when the front wall is in the storage position, and projecting across the slots and engaging portions of the shaft adjacent the top edge of the side wall to help retain the shaft against the support edges when the front wall is in the dispense position. Such a container allows the shaft with a supply roll of the discs around it to be easily inserted into the container by moving the ends of the shaft along the slots, and then locks the ends of the shaft in the slots when the front wall is moved to its dispense position, after which the discs may be dispensed without any problem of dislodging the shaft from within the slots.

Preferably, the container further includes a retention member attached to the front wall along its top edge and projecting toward the shaft, which retention member is adapted to have the adhesive surface of one of the disks adhered thereto to position the adhered disk; and the dispenser further includes a knife attached generally centrally to the front wall which can be used to separate the discs.

Also, the container preferably includes a cover including lip portions adapted to project along the outer surfaces of the side and front walls when the front wall is in its storage position and the cover is in a closed position, which cover is pivotable to an open position spaced from the top edges of the side and front walls to afford movement of the front wall to the dispense position and access to disks on the supply roll, and is adapted to be positioned in a partially closed position with its lip portion closely adjacent the retention member when the front wall is in its dispense position to restrict dust from entering the container.

DESCRIPTION OF DRAWING

The present invention will be further described with reference to the accompanying drawing wherein like reference numerals refer to like parts in the several views, and wherein.

DETAILED DESCRIPTION

Figure 1:
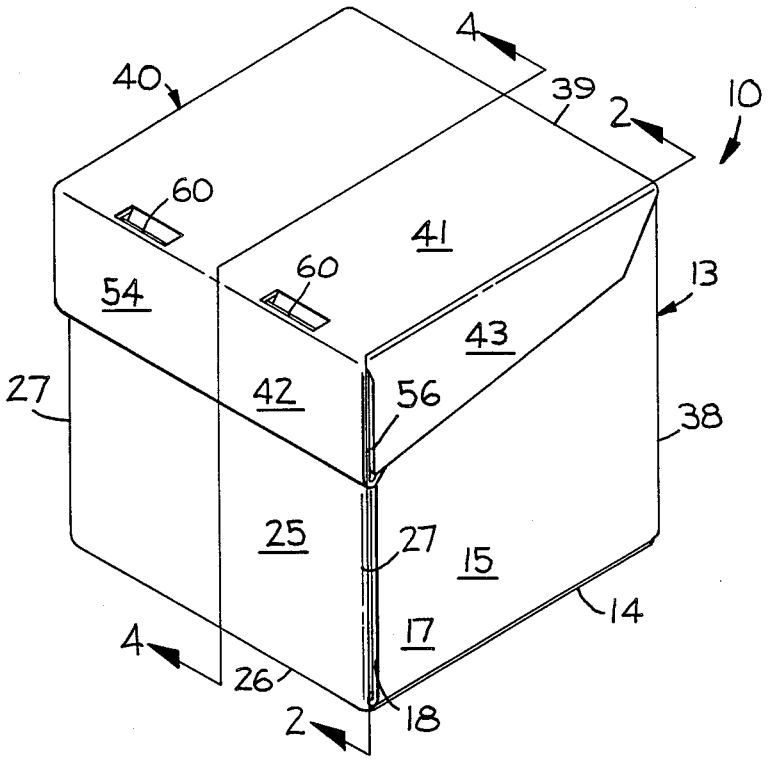
FIG. 1 is a perspective view of a dispenser according to the invention with a cover of the dispenser in a and a front wall of the dispenser in a position.

Referring now to the drawing, there is shown a dispenser according to the present invention generally designated by the reference numeral 10.

Figure 2:
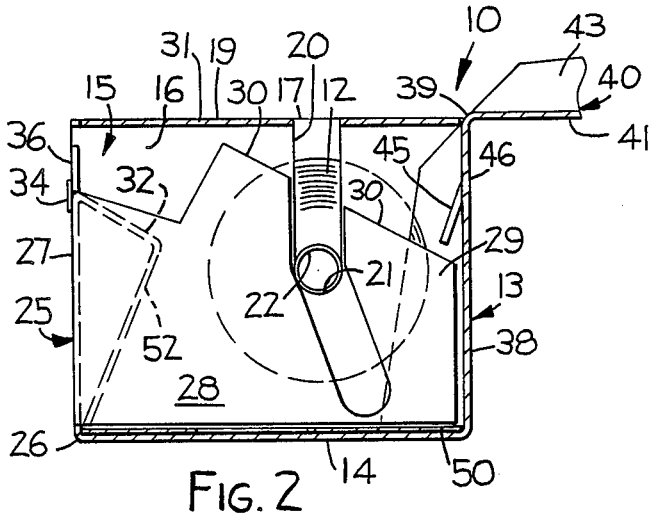
FIG. 2 is a fragmentary sectional view taken along line 1—1 of FIG. 1 and showing the cover of the dispenser in an open position.
Figure 3:
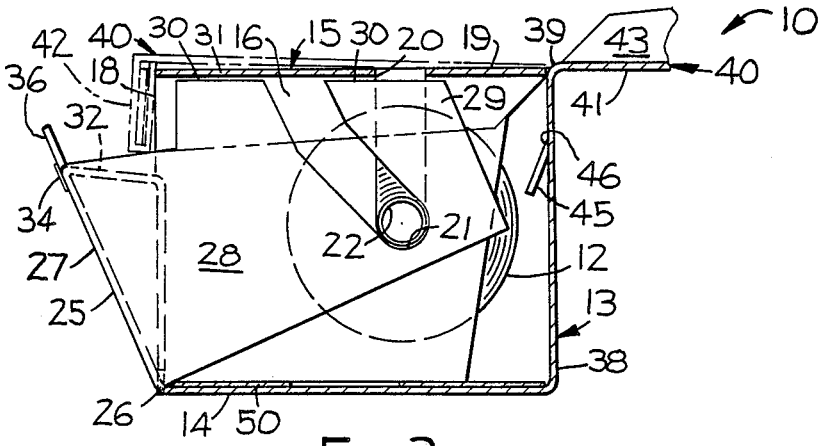
FIG. 3 is a fragmentary sectional view taken along line 1—1 of FIG. 1 showing the front wall of the dispenser in a dispense position, the cover of the dispenser in an open position solid outline, and the cover of the dispenser in a partially closed position in dotted outline.

The dispenser 10 as illustrated is adapted for dispensing pressure sensitive adhesive coated abrasive discs 11 from a concatenation of such discs 11 disposed in a supply roll 12 around a core having a through opening. Generally, the dispenser 10 comprises a corrugated fiberboard container 13 having a bottom wall 14, opposite side walls 15 projecting generally at right angles from opposite edges of the bottom wall 14 and each having inner and outer layers 16 and 17, a front edge 18, and a top edge 19. The inner layers 16 of the side walls 15 have aligned slots 20 extending from the top edges 19 to inner ends positioned generally central of the side walls 15 and have arcuate support edges 21 defining the inner ends of the slots 20. A shaft 22 extends between and a right angle to the outer layers 17 of the side walls 15 and has end portions supported on the support edges 21. The shaft 22 is adapted to extend through and support the core for rotation of the supply roll 12 around the shaft 22. The corrugated fiberboard container 13 also has a front wall 25 having a bottom edge 26 pivotably mounted on the bottom wall 14, projecting along the front edges 18 of the side walls 15, having opposite edges 27 each adjacent one of the side walls 15, and having retaining members 28 attached at the opposite edges 27 of the front wall 25, and each projecting between the layers 16 and 17 of a different one of the side walls 15. The front wall 25 is pivotable around its bottom edge 26 and relative to the side walls 15 between a storage position (FIGS. 1 and 2) with the front wall 25 disposed at a first 90 degree angle relative to the bottom wall 14, and a dispense position (FIGS. 3, 4, and 5) with the front wall 25 disposed at a second greater obtuse angle (e.g., 110 degrees) relative to the bottom wall 14. The retaining members 28 have retaining portions 29 that are spaced from the slots 20 in the inner layers 16 of the side walls 15 when the front wall 25 is in its storage position so that the shaft 22 with the supply roll 12 of discs 11 can be moved along the slots 20 to remove or insert it or to replace an empty core with a core wound with a supply roll 12. When the front wall 25 is in the dispense position, however, the retaining portions 29 project across the slots 20 and engage portions of the shaft 22 adjacent the top edges 19 of the side walls 15 to help retain the shaft 22 against the support edges 21 when discs 11 are pulled from the supply roll 12. The retaining members 28 also are shaped to have top edges 30 along both the retaining portions 29 and portions adjacent the front wall 25 that abut the inner surface of a lip 31 joining the inner and outer layers 16 and 17 at the top edge 19 to define the dispense position of the front wall 25 (see FIGS. 3 and 4).

Figure 4:
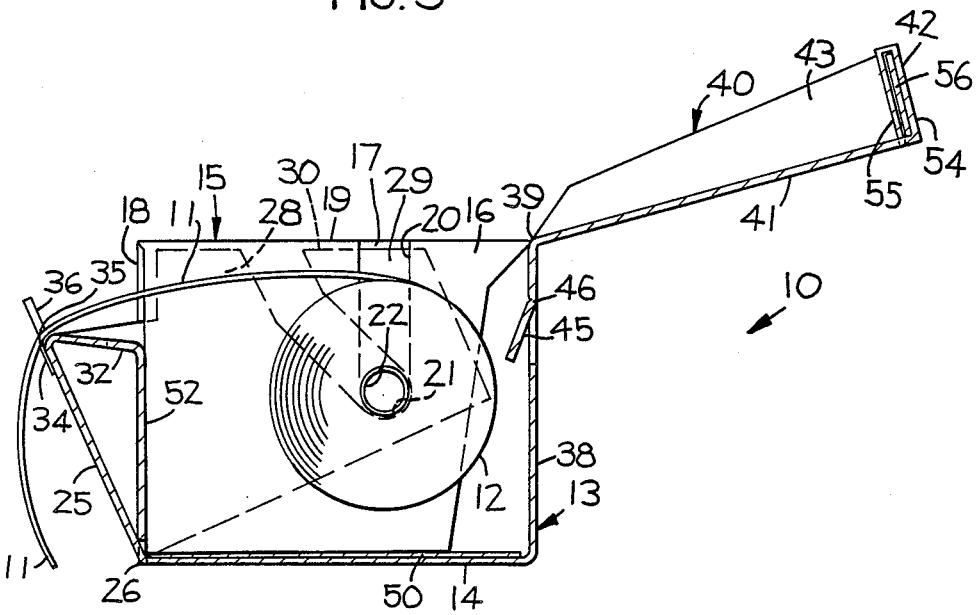
FIG. 4 is a sectional view taken along line 4—4 of FIG. 1 showing the cover of the dispenser in an open position, the front wall of the dispenser in a dispense position, and a disc ready to be dispensed.
Figure 5:
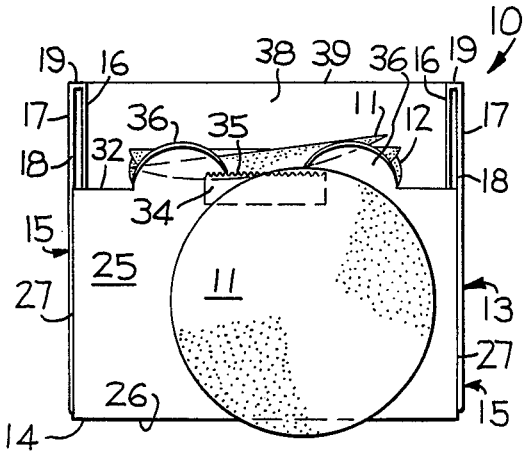
FIG. 5 is a front view of the dispenser as illustrated in FIG. 4.

The container 13 further includes a retention member 32 attached to the front wall 25 along its top edge and projecting away from the front wall 25 toward the shaft 22 at an acute included angle (e.g., about 50 degrees) with the front wall 25. The retention member 32 is adapted to have the adhesive surface of one of the disks 11 adhered thereto adjacent the front wall 25 to support and position the adhered disk 11 for manual engagement for a user desiring to remove a disk from the dispenser 10. A knife 34 having a serrated cutting edge 35 is attached generally centrally to the outer surface of the front wall 25 with the cutting edge 35 projecting above the top edge of the front wall 25, and the front wall 25 further includes a pair of spaced projections 36 opposite ends of and projecting above the cutting edge 35 of the knife 34 adapted to be abutted by the leading edge of the second disk 11 in the supply roll 12 as illustrated in FIGS. 4 and 5 to facilitate using the knife 34 to separate the first and second discs 11 by pulling the connecting portion between them into engagement with the cutting edge 35.

The container 13 also includes a rear wall 38 attached to the edges of the bottom and side walls 14 and 15 opposite the front wall 25 and having a top edge 39 generally aligned with the top edges 19 of the side walls 15; and a cover 40 including a main portion 41 having a rear edge pivotably attached to the top edge 39 of the rear wall 38 and adapted to extend over the top edges 19 of the side walls 15 and the top edge of the front wall 25 when the front wall 25 is in its storage position and the cover 40 is in a closed position. Front and side lip portions 42 and 43 project at right angles to the main portion 41 and are adapted to project along the outer surfaces of the side and front walls 15 and 25 when the cover 40 is in its closed position. The cover 40 is pivotable to an open position (FIGS. 2 through 5) spaced from the top edges of the side and front walls 15 and 25 to afford movement of the front wall 25 to the dispense position and access to disks 11 on the supply roll 12. The cover 40 is also pivotable to a partially closed position illustrated in dotted outline in FIG. 3 when the front wall 25 is in its dispense position, at which partially closed position the front lip portion 42 projects along the front edge 18 of the side wall to a position adjacent the retention member 32. This partially closed position of the cover 40 is useful in dusty environments between dispensing of disks 11 to restrict dust from entering the container 10.

The rear wall 38 of the container 13 has a cut defining an elongate portion 45 of the rear wall 38 disposed parallel to and spaced closely from the top edge 39 of the rear wall 38 and being pivotably attached to a major portion of the rear wall 38 along an edge 46 adjacent the top edge 39 of the rear wall 38 for movement between a portion aligned with the major portion of the rear wall 38 to a position out of alignment with the major portion of the rear wall 38 to provide an access opening for the fingers of a person so that the person can hold or transport the container 13.

As illustrated, all of the walls and portions of the container 13 are formed from a single unitary sheet of corrugated fiberboard, with the outer layers 17 of the side walls 15 being joined along fold lines to opposed flaps 50 at their bottom edges, which flaps 50 extend toward each other along and are adhered along the inner surface of the bottom wall 14, the inner layers 16 being joined to the outer layers of the side walls 15 by the lips 31 along their top edges 19 at double fold lines and having tabs on their ends adjacent the bottom wall 14 that engage slots in the flaps 50, the retaining members 28, retention member 32 and bottom wall 14 being joined at fold lines along edges of the front wall 25, a support member 52 extending along the inner surface of the front wall 25 being joined along a fold line at an edge of the retention member 32 opposite the front wall 25 and having a tab at its end adjacent the bottom wall 14 engaged with a slot in the bottom wall 14, the rear wall 38 being joined along fold lines to the bottom wall 14 and the main portion 41 of the cover 40, and the side lip portions 43 and an outer layer 54 of the front lip portion 42 being joined at fold lines to the edges of the main portion 41, with an inner layer 55 of the front lip portion 42 being joined at a double fold line to the distal edge of its outer layer 54 and having spaced tabs at its distal edge engaged with slots 60 in the main portion 41, and the inner and outer layers 54 and 55 of the front lip portion 42 enfolding opposed tabs 56 joined at fold lines to the adjacent edges of the side lip portions 43.

The present invention has now been described with reference to one embodiment thereof. It will be apparent to those skilled in the art that many changes can be made in the embodiments described without departing from the scope of the present invention. For example, only one of the inner layers of the side walls need be slotted, and the other may be formed with a circular opening that receives an end portion of the shaft, in which case the slot need only extend to adjacent the top edge of the slotted side wall, and only the retaining member in the slotted side wall need engage the shaft when the front wall is moved to its dispense position. Also, the front wall may have only one of the projections and may be relieved to facilitate access to the discs on the supply roll. Thus the scope of the present invention should not be limited to the structures described in this application, but only by structures described by the language of the claims and the equivalents of those structures.

We claim:

1. A dispenser for concatenated pressure sensitive adhesive coated abrasive discs disposed in a supply roll around a core having a through opening, said dispenser comprising:

a corrugated fiberboard container having a bottom wall, opposite side walls projecting generally at right angles from opposite edges of said bottom wall and each having inner and outer layers, a front edge, and a top edge, said inner layers of said side walls having aligned slots extending from said top edges to inner ends positioned generally central of said side walls and having support edges defining the inner ends of said slots, a shaft extending between the outer layers of said side walls and having ends supported on said support edges, said shaft being adapted to extend through and support the core for rotation around said shaft;

said container also having a front wall having a bottom edge pivotably mounted on said bottom wall, projecting along the front edges of said side walls, having opposite edges each adjacent one of said side walls, and having retaining members attached at the opposite edges of said front wall and each projecting between the layers of a different one of said side walls, said front wall being pivotable relative to said side walls between a storage position with said front wall disposed generally at a right angle relative to said bottom wall, and a dispense position with said front wall disposed at an obtuse angle relative to said bottom wall, and said retaining members having retaining portions spaced from the slots in the inner layers of said side walls when said front wall is in said storage position, and projecting across said slots and engaging portions of said shaft adjacent the top edges of said side walls to help retain said shaft against the support edges when said front wall is in said dispense position.

2. A dispenser according to claim 1 wherein said obtuse angle is about 110 degrees.

3. A dispenser according to claim 1 wherein said front wall has a top edge spaced toward said bottom wall from the to edges of said side walls, and said container further includes a retention member attached to said front wall along said top edge and projecting away from said front wall toward said shaft at an acute included angle with said front wall, said retention member being adapted to have the adhesive surface of one of the disks adhered to a portion thereof adjacent said front wall to position the adhered disk.

4. A dispenser according to claim 3 further including a knife having a cutting edge and attached generally centrally to said front wall with said cutting edge projecting above the top edge of said front wall, and said front wall further includes spaced projections at the ends of and projecting above the cutting edge of said knife adapted to be abutted by the second disk in said supply roll to facilitate using said knife to cut between said discs.

5. A dispenser according to claim 3 wherein said container includes a rear wall attached to the edges of said bottom and side walls opposite said front wall and having a top edge generally aligned with the top edge of said side walls; and a cover having a main portion having a rear edge pivotably attached to the top edge of said rear wall and adapted to extend over the top edges of said side walls and the top edge of said front wall when said front wall is in said storage position and said cover is in a closed position, and lip portions projecting at right angles to said main portion adapted to project along the outer surfaces of said side and front walls when said front wall is in said storage position and said cover is in said closed position, said cover being pivotable to an open position spaced from the top edges of said side and front walls to afford movement of said front wall to said dispense position and access to disks on said supply roll, and to a partially closed position when said front wall is in said dispense position with said lip portion adapted to project along said front wall positioned adjacent said retention member.

6. A dispenser according to claim 5 wherein the rear wall of said container has a cut defining an elongate portion of said rear wall disposed parallel to and spaced closely from the top edge of said rear wall and being pivotably attached to an adjacent major portion of said rear wall along an edge adjacent the top edge of said rear wall for movement between a portion aligned with said major portion of said rear wall to a position out of alignment with said major portion of said rear wall to provide an access opening for the fingers of a person so that the person can hold said container.

7. A dispenser according to claim 5 wherein all of the walls and portions of said container are formed from a unitary sheet of corrugated fiberboard.

8. A dispenser according to claim 7 wherein said outer layers of said side walls are joined along fold lines to opposed flaps at their edges opposite their top edges, which flaps extend toward each other along and are adhered to said bottom wall, said inner layers are joined to said outer layers of said side walls along their top edges at double fold lines and have tabs on their ends adjacent said bottom wall that engage slots in said flaps, said retaining members, retention member and bottom wall are joined at fold lines along edges of said front wall, said container includes a support member extending along said front wall, joined along a fold line at an edge of said retention member opposite said front wall, and having a tab at its end adjacent said bottom wall engaged with a slot in said bottom wall, said rear wall is joined along fold lines to said bottom wall and said main portion of said cover, and said side lip portions and an outer layer of said front lip portion are joined at fold lines to edges of said main portion, with an inner layer of said front lip portion being joined at a double fold line to said distal edge of its outer layer and having spaced tabs at its distal edge engaged with slots in said main portion, and said inner and outer layers of said front lip portion enfolding opposed tabs joined at fold lines to said adjacent edges of said side lip portions.

9. A dispenser for strip material disposed in a supply roll having a through opening, said dispenser comprising:

a container having a bottom wall, opposite side walls projecting generally at right angles from opposite edges of said bottom wall and each having inner and outer layers, a front edge, and a top edge, said inner layers of said side walls having openings comprising portions generally central of said side walls and having support edges defining the sides of said openings adjacent said bottom wall, at least one of said openings being a slot extending from adjacent one of said top edges;

a shaft extending between the outer layers of said side walls and having ends supported on said support edges, said shaft being adapted to extend through, and support the supply roll for rotation around said shaft;

said container also having a front wall having a bottom edge pivotably mounted on said bottom wall, projecting along the front edges of said side walls, and having opposite edges each adjacent one of said side walls, and having retaining members attached at the opposite edges of said front wall and each projecting between the layers of a different one of said side walls, said front wall being pivotable relative to said side walls between a storage position with said front wall disposed at generally a right angle relative to said bottom wall, and a dispense position with said front wall disposed at an obtuse angle relative to said bottom wall, and at least said retaining member adjacent said slot having a retaining portion spaced from the slot when said front wall is in said storage position, and projecting across said slot and engaging a portion of said shaft adjacent the top edge of said side wall to help retain said shaft against the adjacent support edge when said front wall is in said dispense position.

10. A dispenser according to claim 9 wherein said obtuse angle is about 110 degrees.

11. A dispenser according to claim 9 wherein said front wall has a top edge spaced from the top edge of said side walls toward said bottom wall and said container further includes a retention member attached to said front wall along said top edge and projecting away from said front wall toward said shaft.

12. A dispenser according to claim 11 further including a knife having a cutting edge and attached generally centrally to said front wall with said cutting edge projecting above the top edge of said front wall.

13. A dispenser according to claim 9 wherein said container includes a rear wall attached to the edges of said bottom and side walls opposite said front wall and having a top edge generally aligned with the top edge of said side walls; and a cover having a main portion having a rear edge pivotably attached to the top edge of said rear wall and adapted to extend over the top edges of said side walls and the top edge of said front wall when said front wall is in said storage position and said cover is in a closed position, and lip portions projecting at right angles to said main portion adapted to project along the outer surfaces of said side and front walls when said front wall is in said storage position and said cover is in said closed position, said cover being pivotable to an open position spaced from the top edges of said side and front walls to afford movement of said front wall to said dispense position and access to strip material on said supply roll, and to a partially closed position when said front wall is in said dispense position with said lip portion adapted to project along said front wall positioned adjacent said retention member.

14. A dispenser according to claim 13 wherein the rear wall of said container has a cut defining an elongate portion of said rear wall disposed parallel to and spaced closely from the top edge of said rear wall and being pivotably attached to an adjacent major portion of said rear wall along an edge adjacent the top edge of said rear wall for movement between a portion aligned with said major portion of said rear wall to a position out of alignment with said major portion of said rear wall to provide an access opening for the fingers of a person so that the person can hold said container.

15. A dispenser according to claim 13 wherein all of the walls and portions of said container are formed from a unitary sheet of corrugated fiberboard.

16. A dispenser for concatenated pressure sensitive adhesive coated abrasive discs disposed in a supply roll around a core having a through opening, said dispenser comprising:

a corrugated fiberboard container having a bottom wall, opposite side walls projecting generally at right angles from opposite edges of said bottom wall and each having inner and outer layers, a front edge, and a top edge, said inner layers of said side walls having aligned slots extending from said top edges to inner ends positioned generally central of said side walls and having support edges defining the inner ends of said slots; and a shaft extending between the outer layers of said side walls and having ends supported on said support edges, said shaft being adapted to extend through and support the core for rotation around said shaft;

said container also having a front wall having a bottom edge pivotably mounted on said bottom wall, projecting along the front edges of said side walls, having opposite edges each adjacent one of said side walls, and having retaining members attached at the opposite edges of said front wall and each projecting between the layers of a different one of said side walls, said front wall being pivotable relative to said side walls between a storage position with said front wall disposed at generally a right angle relative to said bottom wall, and a dispense position with said front wall disposed at an obtuse angle relative to said bottom wall, said front wall having a top edge spaced toward said bottom wall from the top edges of said side walls; a retention member attached to said front wall along said top edge and projecting away from said front wall toward said shaft, said retention member being adapted to have the adhesive surface of one of the disks adhered to a portion thereof adjacent said front wall to position the adhered disk; a rear wall attached to the edges of said bottom and side walls opposite said front wall and having a top edge generally aligned with the top edge of said side walls; and a cover having a main portion having a rear edge pivotably attached to the top edge of said rear wall and adapted to extend over the top edges of said side walls and the top edge of said front wall when said front wall is in said storage position and said cover is in a closed position, and lip portions projecting at right angles to said main portion adapted to project along the outer surfaces of said side and front walls when said front wall is in said storage position and said cover is in said closed position, said cover being pivotable to an open position spaced from the top edges of said side and front walls to afford movement of said front wall to said dispense position and access to disks on said supply roll, and to a partially closed position when said front wall is in said dispense position with said lip portion adapted to project along said front wall positioned adjacent said retention member.

* * * * *